United States Patent [19]

Benke

[11] Patent Number: 4,726,594

[45] Date of Patent: Feb. 23, 1988

[54] DRUG INJECTION SYSTEM FOR USE WITH AN ARROW

[76] Inventor: Gus A. Benke, 7473 Callaghan Rd., #208, San Antonio, Tex. 78229

[21] Appl. No.: 910,205

[22] Filed: Sep. 22, 1986

[51] Int. Cl.[4] ..... F41B 5/04

[52] U.S. Cl. ..... 273/418; 604/130

[58] Field of Search ..... 273/418; 604/130

[56] References Cited

U.S. PATENT DOCUMENTS

| | | | |
|---|---|---|---|
| 2,617,359 | 11/1952 | Van Horn | 102/512 |
| 2,854,925 | 10/1958 | Crockford | 273/418 X |
| 2,995,373 | 8/1961 | Cox | 273/418 |
| 3,006,649 | 10/1961 | Gesick et al. | 273/418 |
| 3,042,406 | 7/1962 | Gregory | 273/418 |
| 3,066,940 | 12/1962 | De Lonais | 273/418 |
| 3,209,695 | 10/1965 | Crockford | 604/130 X |
| 3,359,979 | 12/1967 | Murdoch | 604/130 |
| 3,396,660 | 8/1968 | Bilson et al. | 273/418 X |
| 3,417,697 | 12/1968 | Lucy et al. | 102/436 |
| 3,457,921 | 7/1969 | Waldeisen | 604/130 |
| 3,893,866 | 7/1975 | Hollingsworth | 273/418 |
| 4,124,024 | 11/1978 | Schwebel et al. | 604/130 X |
| 4,174,837 | 11/1979 | Benke | 273/418 |
| 4,597,580 | 7/1986 | Gassie | 273/418 |

FOREIGN PATENT DOCUMENTS 671192 2/1966 Belgium .

OTHER PUBLICATIONS

Catalog from Palmer Chemical and Equipment Co., Palmer Village, Box 867, Douglasville, GA 30134, no information on either data or author.

*Primary Examiner*—Paul E. Shapiro

*Attorney, Agent, or Firm*—Gunn, Lee & Jackson

[57] ABSTRACT

A system for injecting drugs into animals by using a drug injection device that fits onto the end of an arrow. The device consists of a cylindrical cartride that inserts into the hollow shaft or an arrow. Onto the tip of the arrow a needle is attached. A detonator explodes on impact of arrow with the animal and forces drug from cartridge through needle into animal. The system further consists of a dye-marked drug to reveal the use of the drug in the hunting and injection of animals. A method of preparing dye-marked drug and the new composition is shown.

23 Claims, 5 Drawing Figures

DRUG INJECTION SYSTEM FOR USE WITH AN ARROW

BACKGROUND OF THE INVENTION

This invention relates to a device that fits on an arrow and injects animals with drugs, and the drugs used with the device. More particularly, this invention relates to a cartridge that contains a detonator that explodes when the arrow strikes an animal, and thereby forces a drug through a needle into the animal's tissue. More specifically, the drug, prior to impact, is encapsulated by a membrane within a cartridge in the hollow tip of an arrow. Upon impact the detonation drives the capsule onto a member which pierces the membrane containing the drug, forcing the drug through the member and out a needle on the tip of the arrow. It should be noted that the arrow itself does not penetrate the animal and leaves no trace on its skin. This invention also claims a dye-marked drug used with the injecting system and a method of preparing and using the dye-marked drug.

BRIEF DESCRIPTION OF THE PRIOR ART

Drugs or poisons have long been used in the hunting of animals by more primitive societies. Even today the principle is used in guns that fire darts containing some type of drug or immobilizing substance. Typical such immobilization darts are shown in U.S. Pat. No. 2,854,925. In that patent, a projectile to dispense a liquid drug is fired from a gun. The firing causes a blast of gas to force a needle through a thin seal and puncture a receptacle containing a liquid gas-producing reactant. The liquid gas-producing reactant released reacts with a solid gas-producing reactant, the reaction product forcing a plunger forward against a chamber containing a liquid drug. The liquid drug is dispensed to an impacted animal as a result of the plunger forcing the liquid through a needle.

In recent years, the popularity of bow and arrow hunting has increased among sportsmen. Today's hunter, however, does not possess the skill of his forefathers. Furthermore, broadhead-equipped arrows induce death by causing hemorrhaging. It requires great accuracy to efficiently induce death through such means, since the broadhead must generally sever relatively large broad vessels; however, an animal's body contains few blood vessels of adequate size. When a broadhead penetrates the abdominal cavity, death almost invariably results due to infection. As a result, many animals are mortally wounded by arrows each year, yet flee to remote locations to die. Therefore, some states' game laws allow the use of arrows equipped with drug injecting devices. Consequently, there has been increased usage of such arrows.

A typical arrow is shown in U.S. Pat. No. 3,066,940 which illustrates a regulation size broadhead arrow used in conjunction with a preloaded capsule containing a powerful liquid muscle relaxant. In this device, a capsule contained in an arrow shaft is shoved forward upon impact with an animal onto the sharpened rear edge of a broadhead. No compression device is used to forcibly eject the capsule's solution, nor is there a way of deflecting the capsule's wall so it will not impede the outward flow of solution. Also, the hemorrhaging caused by the cutting effect of the broadhead substantially decreases the effectiveness of the drug dispensed. Much of the dosage is transported outside the body of the animal by bleeding or can become trapped within pooled blood (or "bruised") tissue. Should an animal be struck in the abdominal cavity by this device, much of the drug would be lost in intestinal matter since the dosage is released along the broadhead's penetration route.

A method of dispensing a drug by arrow is shown in U.S. Pat. No. 3,893,866. In this invention a sleeve member telescopes along the shank of the arrow so the arrow penetrates the animal, and releases the drug along the path of the penetrated arrow.

Another method of dispensing a drug by arrow is shown in applicant's own U.S. Pat. No. 4,174,837. This patent shows a drug dispensed from the annular recess of a center cylinder slideably receiving the shank of an arrow. The center cylinder has outwardly extending flange hooks to retain the cylinder at the surface of the animal to completely dispense the drug in the muscle tissue of the animal.

A drug that has been used for hunting purposes is succinylcholine chloride (diacetylcholine chloride), a fast-acting, relatively powerful muscle relaxant. This highly stable drug reacts with serum cholinesterase, an enzyme in an animal's circulatory system and hydrolyzes into succinic acid and choline, compounds that are normal body constituents. Hunted game animals, such as deer, are many times more sensitive to this drug than man. Therefore, if a drug holding device is highly efficient, it is possible to use a dosage that is humanely effective for most hunting purposes, yet is harmless to the hunter should he be accidently shot with the arrow.

However, because succinylcholine chloride breaks down into components normally found in a human's or an animal's body, detection of its use is extremely difficult. Because of this, it has been called a "perfect" murder weapon. Succinylcholine chloride is highly absorbent through mucous membrane surfaces and when applied in sufficient concentration to those surfaces is introduced to the body without leaving a mark on the surface. Likewise, the use of succinylcholine chloride with this invention, which produces only an almost invisible needle mark on the animal, makes it difficult to determine how the animal died. In archery hunting under state laws, succinylcholine chloride-equipped arrows may be used on certain species and not others, or in certain geographical areas and not others. This has presented a long-standing problem to law enforcement personnel, because it is almost impossible to determine whether succinylcholine chloride was used in the animal's death. Because of this difficulty, succinylcholine chloride has been disapproved for hunting purposes in many areas. This is unfortunate because succinylcholine chloride is much more efficient and would reduce the incidences of crippling wildlife that result from the use of broadhead arrows.

An effective dye that would mark the under surface of the skin of the animal when injected with succinylcholine chloride would provide a ready means of determining the drug's use. However, most dyes cannot be used due to chemical interaction with the succinylcholine chloride, because the dyes contain toxins or because they lack the potency to be effective markers. To be effective, a dye must be an extremely potent marker, nontoxic and chemically inert.

SUMMARY OF THE INVENTION

It is the object of this invention to provide a drug injection device for hunting purposes that, by explosive charge, injects a drug through a needle in the arrow tip, into the subcutaneous tissue of the animal.

It is a further object of this invention to provide a device that will inject a drug without marring or tearing the skin of the animal.

It is a further object of this invention to provide a new composition based on the widely used (in hunting) drug succinylcholine chloride that will reveal the use of that drug in killing game.

It is a further object of this invention to provide a method by which the new composition based on succinylcholine chloride can be prepared to use effectively as a marking to reveal the use of the drug in killing game animals.

It is a further object of this invention to provide a drug injection device for use with succinylcholine chloride in a manner that the drug's use will be apparent to an observer.

DESCRIPTION OF THE PREFERRED EMBODIMENT

Figure 1:
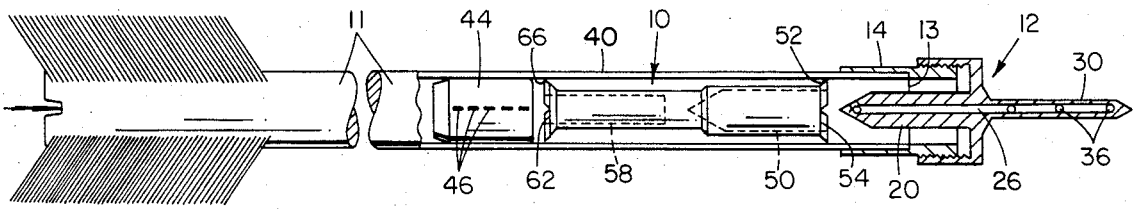
FIG. 1 is an elevated, broken partially sectioned view of an arrow along its longitudinal axis embodying the present invention.

FIG. 1 illustrates a cross-sectional view of the main components of the drug injection system when it is ready for use. Arrow 11 has an opening 15 in the forward end thereof. Inside of opening 15 is a cartridge 10 slidably received therein. Closing the forward end of opening 15 is an injection means 12. Inside of opening 15 to the rear of cartridge 10 is a shaft plug 44. Arrow shaft 40 is hollow. Shaft plug 44 is inserted into shaft 40 a sufficient distance from arrow shaft end 13 to allow for the insertion into shaft 40 of drug cartridge body 10. Drug cartridge body 10 is held in place within shaft 40 by positioning fins 52 and 66, that project from the two ends of drug cartridge body 10. Drug cartridge body 10 is generally cylindrical and elongated to conform with the inside of shaft 40. It is best made of a hard, impact-resistant plastic. When drug cartridge body 10 is properly positioned within shaft 42, rear end 62 of drug cartridge body 10 is close to shaft plug 44.

Injecting body 12 is attached at tip 13 by threading onto attachment collar 14 fixed on arrow shaft 40. When properly positioned and ready for use, as is illustrated in FIG. 1, chamber displacement member 20 is close to front membrane seal 54 of drug cartridge body 10. When arrow 11 is suddenly stopped, as would occur when it strikes an animal, the impact sets off impact detonator 58. The rapidly expanding gas created by the explosion is contained by immobile shaft plug 44 and positioning fins 66 and therefore forces drug cartridge body 10 to slam into chamber displacement member 20, piercing membrane seal 54. The drug contained within drug chamber 50 of drug cartridge body 10 is squeezed by the force of the explosion through chamber displacement member 20 of injecting body 12, through tip orifices 36 of needle 30 into the subcutaneous tissues of the animal (not shown). In this manner, the animal is injected with a premeasured dosage of the drug.

Figure 2:
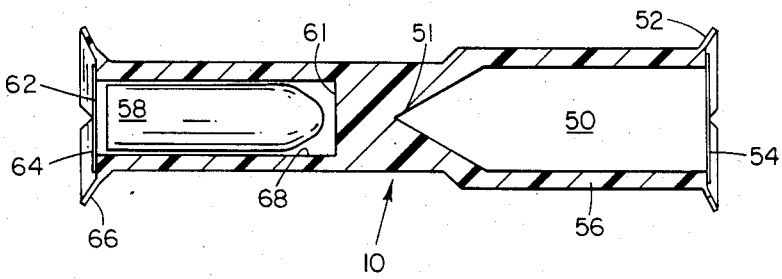
FIG. 2 is an elongated cross-sectional view of a drug cartridge for use in the arrow shown in FIG. 1.
Figure 3:
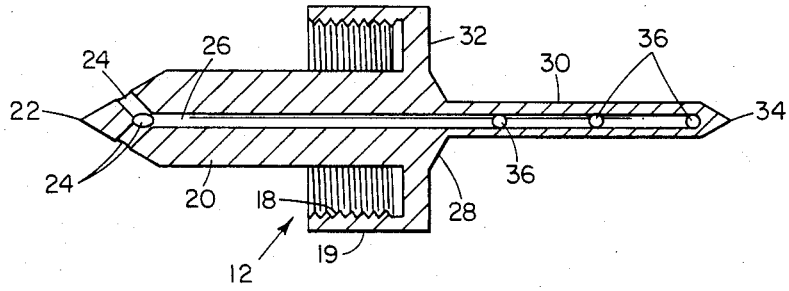
FIG. 3 is a cross-sectional view along its elongated axis of the injection member of the arrow shown in FIG. 1.

FIG. 2 more fully illustrates the components of drug cartridge body 10. The generally cylindrical cartridge body 10 is sealed at ends by membranes 54, 64. Front membrane 54 seals drug chamber 50. Drug chamber 50 is enclosed within the front portion of drug cartridge body 10 and contains the lethal drug. The internal dimensions of drug chamber 50 generally match the exterior of chamber displacement member 20 as is illustrated in FIG. 3. Tip 22 of channel displacement member 20 matches rear end 51 of drug chamber 50. Drug cartridge body 10 encloses, in its rear portion, detonator chamber 68 containing impact detonator 58. Drug cartridge body 10 is sealed at its rearward end by rear membrane seal 64 that encloses impact detonator 58 within detonator chamber 68. When flight of arrow 11 is stopped suddenly, detonator 58 explodes, releasing gas and propelling drug cartridge body 10 forward within arrow shaft 40. The expanding gas is forced rearward through rear end 62 of drug cartridge body 10. It can be seen in FIGS. 2 and 4 that positioning fins 66 both hold cartridge body 10 in place with shaft 40 and also function to seal escaping gases between rear end 62 of cartridge body 10 and arrow shaft plug 44. Arrow shaft plug 44 contains gas release perforations 46 to allow for gradual pressure release of expanding gas. Impact detonator 58 is selected to detonate only upon the impact created when arrow 11 travelling at least 50 feet per second is stopped suddenly. This helps prevent accidental discharge of impact detonator 58.

FIG. 3 illustrates injecting body 12. Rim 19 of injecting body 12 is cylindrical-shaped and has threads 18 on the inner surface. Threads 18 allow injecting body 12 to be screwed onto attachment collar 14 at arrow tip 13. Rim 19 is attached to disc-shaped impact plate 32 which has needle 30 extending forward from center of plate 32, and chamber displacement member 20 extending rearward from center of plate 32. In this fashion, needle 30 and chamber displacement member 20 are pointed outward from plate 32. Internal channel 26 extends along the longitudinal axis of chamber displacement member 20 and needle 30 and connects with orifices 24 in surface of chamber displacement member 20 and orifices 36 in surface of needle 30. The number, size and pattern of orifices 24 and 36 may be altered to utilize different dosages of drug. That is, an injecting body with only a few small orifices would inject a smaller dose into the animal than an injecting body with larger orifices. This assumes that the impulse created by impact detonator 58 in each case is the same. The shape of chamber displacement member 20 is generally cylindrical with pointed tip 22. When impact detonator 58 is activated and drug cartridge body 10 thrust forward within shaft 40, front membrane seal 54 is pierced by pointed tip 22. As drug cartridge body 10 continues forward, chamber displacement member 20 displaces liquid drug from drug chamber 50 through orifice 24, internal channel 26 and out needle orifices 36. In this manner, the lethal drug is injected into subcutaneous tissues of the animal. It can be seen from the broad flat shape of impact plate 32 that allow 11 will not penetrate the animal except for needle 30. Arrow 11 impacts target animal, injects a premeasured dosage of drug and immediately falls out. Field tests have shown that the drug injection is instanteous upon impact and that arrow 11 leaves no mark on the animal. The use of the term "drug" in this application is intended to encompass all chemicals that may incapacitate or kill animals, and is not limited to chemicals with only therapeutic benefits.

Figure 4A:
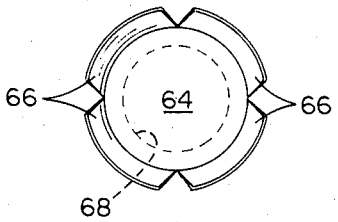
FIG. 4A is a rear view of the drug cartridge shown in FIG. 2.
Figure 4B:
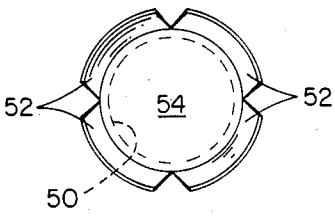
FIG. 4B is a front view of the drug cartridge shown in FIG. 2.

FIG. 4A illustrates a rear view of drug cartridge body 10 showing rear membrane seal 64 and positioning fins 66. It can be seen in this view and FIG. 4B where and how positioning fins 52, 66 are attached to drug cartridge body 10. It further shows how positioning fins 52, 66 are shaped slightly larger than interior radius of arrow shaft 40 so as to bend and fit snugly within. Because positioning fins 52, 66 are flexible material, they will bend when drug cartridge body 10 is inserted into arrow shaft 40, and hold drug cartridge body 10 in place within arrow shaft 40. Further, the contact between positioning fins 66 and interior wall of shaft 40 creates a seal that will help prevent the escape of gases from between rear end 62 of cartridge body 10 and arrow shaft plug 44.

In the preferred embodiment the lethal drug contained within drug chamber 50 is succinylcholine chloride and FD&C Blue Dye No. 1 mixed and in solution. The solution, when injected in an animal, leaves a bright telltale blue mark. In an alternate embodiment, FD&C Blue Dye No. 2 is used in place of FD&C Blue Dye No. 1. Research by inventor indicates that Blue Dye No. 1 to be a good marker. The concentration required to create a bright stain is between one-half to six milligrams of FD&C Blue Dye No. 1 per 100 milligrams of powdered succinylcholine chloride. For succinylcholine chloride solution, the concentration is in the range one to eight milligrams of FD&C Blue Dye No. 1 per one milliliter of solution. The most effective range disclosed by experimentation and to be preferred is one to three milligrams of FD&C Blue Dye No. 1 per 100 milligrams of powdered succinylcholine chloride. For succinylcholine chloride solution, the preferred range is two to four milligrams of FD&C Blue Dye No. 1 per milliliter of succinylcholine chloride solution.

I claim:

1. A device for injecting drugs for use in hunting animals with a bow and arrow comprising:

an arrow having an opening at a forward end to receive cartridge means within said opening of said arrow;

cartridge means being generally elongated and cylindrical, sized to slidably fit within said opening of said arrow, said cartridge means having a body with a forward chamber containing a drug therein and a rear chamber containing a detonation means, said detonation means being designed to explode on impact of said arrow with said animal; and an injecting means attached over said opening on said forward end of said arrow, and including displacement means for forcing said drug from said forward chamber, said detonation means forcing said cartridge means forward over said displacement member to cause said drug in said forward chamber to flow therefrom through said injecting means into said animal.

2. The device in claim 1 wherein said drug is a solution of succinylcholine chloride and FD&C Blue Dye No. 1, thereby making the use of succinylcholine chloride visible on animal tissue.

3. The device in claim 1 wherein said drug is a solution of succinylcholine chloride and FD&C Blue Dye No. 2, thereby making the use of succinylcholine chloride visible on animal tissue.

4. The device in claim 1 wherein said cartridge means further comprises a plurality of positioning fins projecting radially outward from the surface of said body and adapted to bendably contact said arrow and center said cartridge means when said cartridge means is slidably received therein.

5. The device in claim 1 wherein said forward chamber of said forward chamber is releasably sealed with a forward chamber seal membrane.

6. The device in claim 1 wherein said rear chamber of said cartridge means containing said detonation means therein is releasably sealed with a rear chamber seal membrane, said rear chamber seal membrane rupturing when said detonation means explodes.

7. The device in claim 1 wherein said opening is generally cylindrical in nature, an interior surface of a shaft of said arrow comprising sidewalls of said opening, and a plug comprising the rearward wall of said opening.

8. The device in claim 1 wherein said detonation means is adapted to explode when said arrow is travelling at a minimum speed of 50 feet per second and strikes said animal.

9. The device in claim 1 wherein said injecting means further comprises a rim portion generally cylindrical and having threads on an inside surface thereof to threadably attach to tip of said arrow;

an impact plate generally circular attached along a perimeter of said rim thereby forming a wall at said forward end of said arrow when said injecting means is threadably mounted on said arrow;

said displacement member being the same general dimension as said forward chamber and projecting rearwardly from said impact plate, said displacement member having an internal channel therethrough, said internal channel in fluid communication with a displacement member orifice on a rear surface of said displacement member;

a needle projecting forward from said impact plate with said internal channel of said displacement member extending along a longitudinal axis of said needle to needle orifices on a surface of said needle, said needle orifices in fluid communication with said internal channel;

said injecting means slidably receiving said forward chamber of said cartridge means onto said displacement member of said injecting means, thereby forcing said drug within said forward chamber into said displacement member orifice, through said internal channel and out said needle orifices into said animal.

10. The device in claim 1 further comprising:

a tip collar generally cylindrical and attachable over said forward end of said arrow, said tip collar having threads on an outside surface thereof; and injecting means threadably attaching to said tip collar.

11. A method of marking game animals killed by injection comprising the following steps:

mixing a solution of nontoxic, chemically inert marker dye with a muscle-relaxant drug; and preparing a cartridge with said solution sealed therein;

fitting said cartridge with an impact detonation means;

inserting said cartridge in a forward end of a projectile;

enclosing said cartridge inside said forward end of said projectile by an injection means;

causing said projectile to impact an external surface of said game animal, said impact causing an explosion of said impact detonation means, forcing said solution through said injection means into said game animal whereby said solution marks said game animal to indicate a particular drug used to kill said game animal.

12. The method of marking game animals killed by injection as claimed in claim 11 wherein said mixing step further comprises mixing a solution of succinylcholine chloride and FD&C Blue Dye No. 1.

13. The method of marking game animals killed by injection as claimed in claim 12 wherein said mixing step further comprises mixing a solution of one-half to six milligrams of FC&C Blue Dye No. 1 per 100 milligrams of succinylcholine chloride.

14. The method of marking game animals killed by injection as claimed in claim 12 wherein said mixing step further comprises mixing a solution of one to eight milligrams of FD&C Blue Dye No. 1 per 100 milliliters of succinylcholine chloride.

15. The method of marking game animals killed by injection as claimed in claim 11 wherein said mixing step further comprises mixing a solution of succinylcholine chloride and FD&C Blue Dye No. 2.

16. The method of marking game animals killed by injection as claimed in claim 15 wherein said mixing step further comprises mixing a solution of one-half to six milligrams of FD&C Blue Dye No. 2 per 100 milligrams of succinylcholine chloride.

17. The method of marking game animals killed by injection as claimed in claim 15 wherein said mixing step further comprises mixing a solution of one to eight milligrams of FD&C Blue Dye No. 2 per 100 milliliters of succinylcholine chloride.

18. An apparatus for injecting a solution into an animal comprising:

a projectile to be propelled through the air at a high velocity to impact with said animal;

needle means on a forward end of said projectile;

cartridge means inside said projectile, with a forward portion of said cartridge means containing a solution therein, said solution comprising succinylcholine chloride and dye mixture, and a rearward portion of said cartridge means containing an impact explosive substance; and displacement means for displacing said solution from said forward portion of said cartridge means whereby when said projectile impacts said animal, said impact explosive substance explodes, forcing said cartridge forward over said displacement means and said solution out said needle means into said animal, said dye leaving a mark on said animal to indicate said succinylcholine chloride was injected into said animal.

19. The device as claimed in claim 18 wherein said solution further comprises a mixture of FD&C Blue Dye No. 1 and succinylcholine chloride in a weight ratio range between one part said FD&C Blue Dye No. 1 to 18 parts said succinylcholine chloride and one part said FD&C Blue Dye No. 1 to 200 parts said succinylcholine chloride.

20. The device as claimed in claim 18 wherein said solution further comprises a mixture of FD&C Blue Dye No. 2 and succinylcholine chloride in a weight ratio range between one part said FD&C Blue Dye No. 1 to 18 parts said succinylcholine chloride and one part said FD&C Blue Dye No. 1 to 200 parts said succinylcholine chloride.

21. The device as claimed in claim 18 wherein said solution further comprises the combination of succinylcholine chloride solution and FD&C Blue Dye No. 1 in a range from one milligram of said dye per milliliter of said solution to eight milligrams of said dye per milliliter of said solution.

22. The device as claimed in claim 18 wherein said solution further comprises the combination of succinylcholine chloride solution and FD&C Blue Dye No. 2 in a range from one milligram of said dye per milliliter of said solution to eight milligrams of said dye per milliliter of said solution.

23. A device for injecting drugs for use in hunting animals with a bow and arrow, comprising:

an arrow, said arrow being generally hollow and having a tip chamber with inner walls at a forward end thereof, said tip chamber having a longitudinal axis;

a plug, said plug located within and adapted to fit tightly inside said arrow, said plug making up the rearward wall of said tip chamber, said plug containing perforations therein, whereby gas from said tip chamber can slowly leak therethrough;

a cartridge body, said cartridge body being generally cylindrical with a longitudinal axis and adapted to slidably fit within said tip chamber of said arrow, said cartridge body further comprising a first chamber located in a forward portion of said cartridge body and adapted to receive a premeasured dosage of said drug; said first chamber sealed by a first membrane seal capable of being pierced upon impact, thereby releasably sealing said drug within said first chamber of said cartridge body; a second chamber located in a rearward portion of said cartridge body, said second chamber being adapted to receive an impact detonator therein; a second membrane seal adapted to releasably seal said impact detonator within said second cartridge chamber; a plurality of positioning fins, said positioning fins constructed of a hard but flexible material and extending from said cartridge body in a manner so as to contact said inner walls of said tip chamber when said cartridge body is slidably engaged therein, and thereby positioning said longitudinal axis of said cartridge body in alignment with said longitudinal axis of said tip chamber; and said impact detonator adapted to explode when said arrow in flight stops suddenly upon impact with said animal;

an attachment collar with threads thereon adapted to fit over said tip chamber of said arrow;

an injecting body detachably mounted on the forward end of said arrow and, when mounted, forming a forward wall of said tip chamber, said injecting body further comprising: a rim portion, generally cylindrical and having threads on an inside surface thereof, being adapted to threadably attach to said attachment collar of said arrow; an impact plate generally circular and fixedly attached at a perimeter of said impact plate to an edge of said rim, thereby forming a wall at the forward end of said tip chamber when said injecting body is threadably mounted on said arrow; a drug chamber displacement member of the same general dimensions as said first chamber, projecting inwardly from said impact plate into said tip chamber, said drug chamber displacement member having an internal channel therethrough, said channel in communication with a drug chamber displacement member orifice on said drug chamber displacement member; and a needle, said needle projecting forwardly from said impact plate, with said channel of said drug chamber displacement member extending into said needle along a longitudinal axis of said needle, with a needle orifice in communication with said channel;

whereby said arrow, upon impact with said animal will discharge said impact detonator, thereby driving said cartridge body onto said drug chamber displacement member, piercing said first membrane and displacing said drug through said channel, through said needle, out said needle orifice and into tissue of said animal.

* * * * *